US010589154B2

(12) United States Patent
Seluga et al.

(10) Patent No.: US 10,589,154 B2
(45) **Date of Patent: *Mar. 17, 2020**

(54) GOLF CLUB HEAD HAVING ADJUSTABLE STRESS-REDUCING STRUCTURES

(71) Applicant: Callaway Golf Company, Carlsbad, CA (US)

(72) Inventors: James A. Seluga, Carlsbad, CA (US); Christopher A. G. Nunez, Escondido, CA (US); Matthew Myers, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/363,899

(22) Filed: Mar. 25, 2019

(65) Prior Publication Data

US 2019/0217167 A1 Jul. 18, 2019

Related U.S. Application Data

(63) Continuation of application No. 15/392,818, filed on Dec. 28, 2016, now Pat. No. 10,238,933, which is a (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/04* (2013.01); *A63B 53/047* (2013.01);
(Continued)

(58) Field of Classification Search
CPC ..... A63B 53/0466; A63B 2053/0491; A63B 2053/0416; A63B 2209/00;
(Continued)

(56) References Cited

U.S. PATENT DOCUMENTS 3,652,094 A * 3/1972 Glover ..... A63B 53/08 473/337
4,775,156 A * 10/1988 Thompson ..... A63B 53/04 473/328

(Continued)

*Primary Examiner* — William M Pierce
(74) *Attorney, Agent, or Firm* — Rebecca Hanovice; Michael Catania; Sonia Lari

(57) ABSTRACT

A golf club head comprising a body and a plurality of adjustable stiffening members is disclosed herein. The body comprises a face section, a sole section, and a crown section or a return section, and also defines a hollow interior. Each of the plurality of stiffening members is at least partially disposed within the hollow interior, and extends from the crown section or return section to the sole section to reduce stresses placed on the face during impact with a golf ball. The stiffening members, each of which comprises a rod and a tube, may be adjusted to be in compression or tension, thereby preloading the body and affecting the stresses experienced by the golf club head upon impact with a golf ball.

20 Claims, 4 Drawing Sheets

Related U.S. Application Data continuation-in-part of application No. 15/167,588, filed on May 27, 2016, now Pat. No. 9,889,349, which is a continuation-in-part of application No. 15/051,361, filed on Feb. 23, 2016, now Pat. No. 9,757,629, which is a continuation-in-part of application No. 14/997,199, filed on Jan. 15, 2016, now abandoned, which is a continuation-in-part of application No. 14/622,606, filed on Feb. 13, 2015, now Pat. No. 9,345,936, which is a continuation of application No. 13/906,572, filed on May 31, 2013, now Pat. No. 8,956,244, said application No. 14/997,199 is a continuation-in-part of application No. 14/788,326, filed on Jun. 30, 2015, now Pat. No. 9,597,558, and a continuation-in-part of application No. 14/794,578, filed on Jul. 8, 2015, now Pat. No. 9,814,947, which is a continuation-in-part of application No. 14/755,068, filed on Jun. 30, 2015, now Pat. No. 9,623,302, and a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/665,203, filed on Jun. 27, 2012, provisional application No. 61/684,079, filed on Aug. 16, 2012, provisional application No. 62/424,223, filed on Nov. 18, 2016.

(51) Int. Cl.
*A63B 60/42* (2015.01)
*A63B 60/00* (2015.01)
*A63B 60/50* (2015.01)

(52) U.S. Cl.
CPC ..... *A63B 53/0466* (2013.01); *A63B 60/42* (2015.10); *A63B 60/50* (2015.10); *A63B 2053/045* (2013.01); *A63B 2053/0408* (2013.01); *A63B 2053/0412* (2013.01); *A63B 2053/0433* (2013.01); *A63B 2053/0437* (2013.01); *A63B 2053/0491* (2013.01); *A63B 2060/002* (2015.10); *A63B 2209/00* (2013.01); *A63B 2209/02* (2013.01); *A63B 2225/09* (2013.01)

(58) Field of Classification Search
CPC ..... A63B 53/0475; A63B 53/047; A63B 2053/0412; A63B 2053/0458; A63B 2053/0433; A63B 2053/0454
USPC ..... 473/335
See application file for complete search history.

(56) References Cited

U.S. PATENT DOCUMENTS 5,429,365 A * 7/1995 McKeighen ..... A63B 53/04 473/346
5,489,097 A * 2/1996 Simmons ..... A63B 53/0487 473/326
5,766,094 A * 6/1998 Mahaffey ..... A63B 53/04 473/342
6,149,533 A * 11/2000 Finn ..... A63B 53/02 473/336
6,299,547 B1 * 10/2001 Kosmatka ..... A63B 53/04 473/329
6,332,847 B2 * 12/2001 Murphy ..... A63B 53/04 473/324
6,383,090 B1 * 5/2002 O'Doherty ..... A63B 53/0466 473/329
6,435,978 B1 * 8/2002 Galloway ..... A63B 53/02 473/305
6,475,100 B1 * 11/2002 Helmstetter ..... A63B 53/02 473/309
6,524,197 B2 * 2/2003 Boone ..... A63B 53/0466 473/324
6,835,145 B2 * 12/2004 Tsurumaki ..... A63B 53/02 473/345
6,852,038 B2 * 2/2005 Yabu ..... A63B 53/04 473/224
6,923,734 B2 * 8/2005 Meyer ..... A63B 53/04 473/336
6,979,270 B1 * 12/2005 Allen ..... A63B 53/04 473/290
7,066,835 B2 * 6/2006 Evans ..... A63B 53/0466 473/346
7,108,609 B2 * 9/2006 Stites ..... A63B 53/06 473/256
7,118,493 B2 * 10/2006 Galloway ..... A63B 53/02 473/329
7,166,041 B2 * 1/2007 Evans ..... A63B 53/0466 473/334
7,351,161 B2 * 4/2008 Beach ..... A63B 53/0466 473/334
7,387,579 B2 * 6/2008 Lin ..... A63B 53/04 473/332
7,445,563 B1 * 11/2008 Werner ..... A63B 53/0466 473/332
7,691,006 B1 * 4/2010 Burke ..... A63B 53/06 473/288
7,775,905 B2 * 8/2010 Beach ..... A63B 53/0466 473/334
7,914,393 B2 * 3/2011 Hirsch ..... A63B 53/0466 473/332
8,663,027 B2 * 3/2014 Morales ..... B23K 20/021 473/329
8,834,294 B1 * 9/2014 Seluga ..... A63B 53/04 473/338
8,888,607 B2 * 11/2014 Harbert ..... A63B 53/04 473/307
8,956,244 B1 * 2/2015 Westrum ..... A63B 53/04 473/338
9,067,110 B1 * 6/2015 Seluga ..... A63B 53/0466
9,079,078 B2 * 7/2015 Greensmith ..... A63B 53/0466
9,220,953 B2 * 12/2015 Beach ..... A63B 53/06
9,486,677 B1 * 11/2016 Seluga ..... A63B 53/0466
9,597,558 B1 * 3/2017 Seluga ..... A63B 53/0466
9,597,561 B1 * 3/2017 Seluga ..... A63B 53/06
10,369,435 B1 * 8/2019 Myers ..... A63B 53/06
2005/0272523 A1 * 12/2005 Atkins, Sr. ..... A63B 53/0466 473/329
2010/0273565 A1 * 10/2010 Stites ..... A63B 53/04 473/282
2010/0304887 A1 * 12/2010 Bennett ..... A63B 53/0475 473/336
2010/0331101 A1 * 12/2010 Sato ..... A63B 53/0466 473/336
2011/0039634 A1 * 2/2011 Tavares ..... A63B 53/0466 473/335
2011/0152001 A1 * 6/2011 Hirano ..... A63B 53/0466 473/337
2011/0224017 A1 * 9/2011 Thomas ..... A63B 53/0466 473/332
2012/0094780 A1 * 4/2012 Slaughter ..... A63B 53/00 473/316
2012/0165115 A1 * 6/2012 Matsunaga ..... A63B 53/04 473/336
2012/0289360 A1 * 11/2012 Breier ..... A63B 53/047 473/335

(56) References Cited

U.S. PATENT DOCUMENTS

| | | | | |
|---|---|---|---|---|
| 2012/0302367 | A1* | 11/2012 | Myrhum | A63B 53/0466<br>473/324 |
| 2013/0102410 | A1* | 4/2013 | Stites | A63B 53/0466<br>473/335 |
| 2013/0130829 | A1* | 5/2013 | Bennett | A63B 53/0466<br>473/337 |
| 2013/0130834 | A1* | 5/2013 | Stites | A63B 53/0466<br>473/346 |
| 2013/0184099 | A1* | 7/2013 | Stites | A63B 53/0466<br>473/338 |
| 2013/0324299 | A1* | 12/2013 | Clausen | A63B 53/0466<br>473/335 |
| 2015/0165280 | A1* | 6/2015 | Hebreo | A63B 60/00<br>473/342 |

* cited by examiner

GOLF CLUB HEAD HAVING ADJUSTABLE STRESS-REDUCING STRUCTURES

CROSS REFERENCES TO RELATED APPLICATIONS

The present application is a continuation of U.S. patent application Ser. No. 15/392,818, filed on Dec. 28, 2016, and issued on Mar. 26, 2019, as U.S. Pat. No. 10,238,933, which claims priority to U.S. Provisional Patent Application No. 62/424,223, filed on Nov. 18, 2016, and is a continuation-in-part of U.S. patent application Ser. No. 15/167,588, filed on May 27, 2016, which is a continuation-in-part of U.S. patent application Ser. No. 15/051,361, filed on Feb. 23, 2016, which is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, which is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012, the disclosure of each of which is hereby incorporated by reference in its entirety herein. U.S. patent application Ser. No. 15/167,588 also is a continuation-in-part of U.S. patent application Ser. No. 14/713,090, filed on May 15, 2015, and issued on May 31, 2016, as U.S. Pat. No. 9,352,199, which is a continuation of U.S. patent application Ser. No. 14/159,262, filed on Jan. 20, 2014, and issued on Jun. 30, 2015, as U.S. Pat. No. 9,067,110, the disclosure of each of which is hereby incorporated by reference in its entirety herein. U.S. patent application Ser. No. 14/997,199 also is a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with adjustable stress-reducing stiffening members disposed proximate a striking face and composed of a high-strength material such as titanium alloy.

Description of the Related Art

The prior art discloses various golf club heads having interior structures. For example, Kosmatka, U.S. Pat. No. 6,299,547 for a Golf Club Head with an Internal Striking Plate Brace, discloses a golf club head with a brace to limit the deflection of the striking plate. Yabu, U.S. Pat. No. 6,852,038 for a Golf Club Head and Method of Making the Same, discloses a golf club head with a sound bar. Galloway, U.S. Pat. No. 7,118,493 for a Multiple Material Golf Club Head discloses a golf club head with a composite aft body having an interior sound component extending upward from a sole section of a metal face component. Seluga et al., U.S. Pat. No. 8,834,294 for a Golf Club Head with Center of Gravity Adjustability discloses a golf club head with a tube having a mass for adjusting the CG of a golf club head. Dawson et al., U.S. Pat. No. 8,900,070 for a Weighted Golf Club Head discloses a golf club head with an interior weight lip extending from the sole towards the face. However, the prior art fails to disclose an interior structure that increases ball speed and reduces stress in the face at impact, with a minimal increase in mass to the golf club head, and that can be adjusted to preload the golf club head.

BRIEF SUMMARY OF THE INVENTION

The golf club head comprises a plurality of interior structures located proximate a rear surface of a striking face to reduce the stress in the face during impact with a golf ball. In a preferred embodiment, the structures are two-piece stiffening members that can be extended or compressed by a golfer or manufacturer to preload the body, and thereby adjust the stresses experienced by certain portions of the golf club head.

One aspect of the present invention is a golf club head comprising a body with a striking face section, a sole section, and a return section, the sole section and return section defining an upper opening and a hollow interior in communication with the upper opening, at least one stiffening member comprising an externally-threaded rod and a tube having an internally threaded bore, and a crown insert sized to close the upper opening, wherein at least a portion of the rod is disposed within the internally threaded bore, wherein the length of the at least one stiffening member can be adjusted by altering the position of the externally threaded rod within the internally threaded bore, wherein the at least one stiffening member is at least partially disposed within the hollow interior and extends parallel with the striking face section between the return section and the sole section, and wherein the at least one stiffening member is disposed no more than 1 inch from an interior surface of the striking face section in a front-to-back direction. In some embodiments, the rod may comprise a first portion with a first set of external threads and a second portion with a second set of external threads, the first set of external threads may be oriented in a different direction than the second set of external threads, the internally-threaded bore may comprise a first set of internal threads, and the first set of internal threads may be oriented such that it mates with only one of the first and second sets of external threads. In a further embodiment, the tube may comprise a first end, a second end, and a third set of external threads, the internally threaded bore may be disposed at the first end, and the third set of external threads may be disposed at the second end. The rod may further comprise a tool engagement feature proximate the first set of external threads, which may mate with the second set of external threads, and using a tool to tighten the rod with respect to the tube may cause the rod to move further into the internally threaded bore. In these embodiments, moving the rod further into the tube may put at least a portion of the body in compression, and moving the rod further out of the tube may put at least a portion of the body in tension.

In some embodiments, the return section may comprise a first set of threaded openings, the sole section may comprise a second set of threaded openings that may be aligned with the first set of threaded openings, a portion of the rod may be disposed within an opening from the first set of threaded openings, and a portion of the tube may be disposed within an opening from the second set of threaded openings. In another embodiment, a portion of the rod may be disposed within an opening from the second set of threaded openings, and a portion of the tube may be disposed within an opening from the first set of threaded openings. In any of the embodiments, the body may be composed of a metal alloy such as titanium alloy or steel, and the crown insert may be composed of a carbon composite material. Each stiffening member may be composed of at least one metal material, such as titanium alloy or steel.

Another aspect of the present invention is a golf club head comprising a face portion, a crown portion extending from an upper edge of the face portion, a sole portion extending from a lower edge of the face portion, a hollow interior, and at least one stiffening member comprising an externally-threaded rod and a tube having an internally threaded bore, wherein at least a portion of the externally-threaded rod is disposed within the internally threaded bore, wherein the length of the at least one stiffening member can be adjusted by altering the position of the externally threaded rod within the internally threaded bore, wherein the at least one stiffening member is at least partially disposed within the hollow interior, wherein the at least one stiffening member is engaged with each of the crown portion and the sole portion, and wherein the at least one stiffening members is disposed no more than 0.500 inch in a front-to-back direction from an interior surface of the face portion. In some embodiments, the at least one stiffening member may extend parallel with the interior surface of the face portion. In other embodiments, the sole portion may comprise at least one cutout section, which may be sized to receive a sole insert, which itself may be composed of a composite material.

In some embodiments, the crown portion may comprise a first set of threaded openings, the sole portion may comprise a second set of threaded openings, and each opening from the second set of threaded openings may be aligned with an opening from the first set of threaded openings. In a further embodiment, a portion of the rod may be disposed within an opening of the first set of threaded openings, and a portion of the tube may be disposed within an opening from the second set of threaded openings. In an alternative embodiment, a portion of the tube may be disposed within an opening from the first set of threaded openings, and a portion of the rod may be disposed within an opening of the second set of threaded openings.

Yet another aspect of the present invention is a golf club head comprising a body comprising a striking face section, a sole section extending from a lower edge of the striking face section, and a return section extending from an upper edge of the striking face section, the sole section and return section defining an upper opening and a hollow interior in communication with the upper opening, at least one stiffening member comprising an externally-threaded rod and a tube having an internally threaded bore, and wherein at least a portion of the rod is disposed within the internally threaded bore, wherein the rod comprises a first portion with a first set of external threads and a second portion with a second set of external threads, wherein the first set of external threads is oriented in a different direction than the second set of external threads, wherein the internally-threaded bore comprises a first set of internal threads, wherein the first set of internal threads is oriented such that it mates with only one of the first and second sets of external threads, wherein the length of the at least one stiffening member can be adjusted by altering the position of the externally threaded rod within the internally threaded bore, wherein the at least one stiffening member is at least partially disposed within the hollow interior and extends parallel with an interior surface of the striking face section between the return section and the sole section, wherein the at least one stiffening member is engaged with each of the return section and the sole section, and wherein the at least one stiffening member is disposed no more than 1 inch from the interior surface of the striking face section in a front-to-back direction.

In some embodiments, the at least one stiffening member may be disposed no more than 0.433 inch from the interior surface of the striking face section in a front-to-back direction. In other embodiments, the golf club head may have a volume of 420 cubic centimeters to 470 cubic centimeters and a mass of no more than 215 grams.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
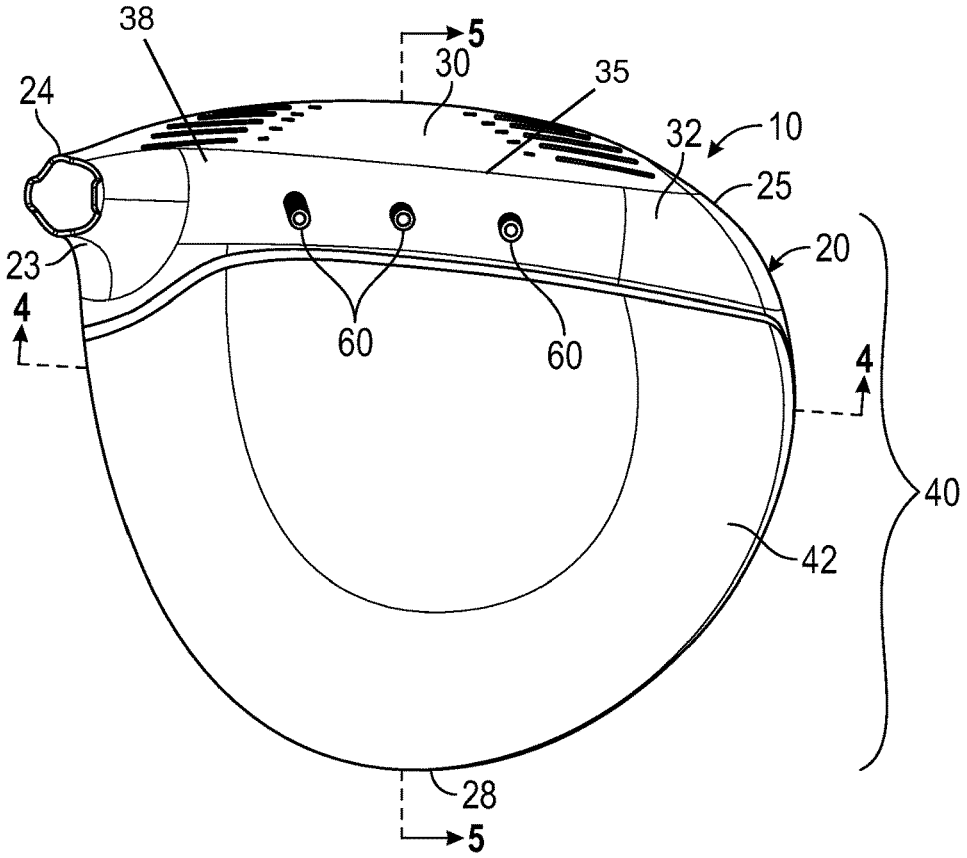
FIG. 1 is a top elevational view of an embodiment of the golf club head of the present invention.
Figure 2:
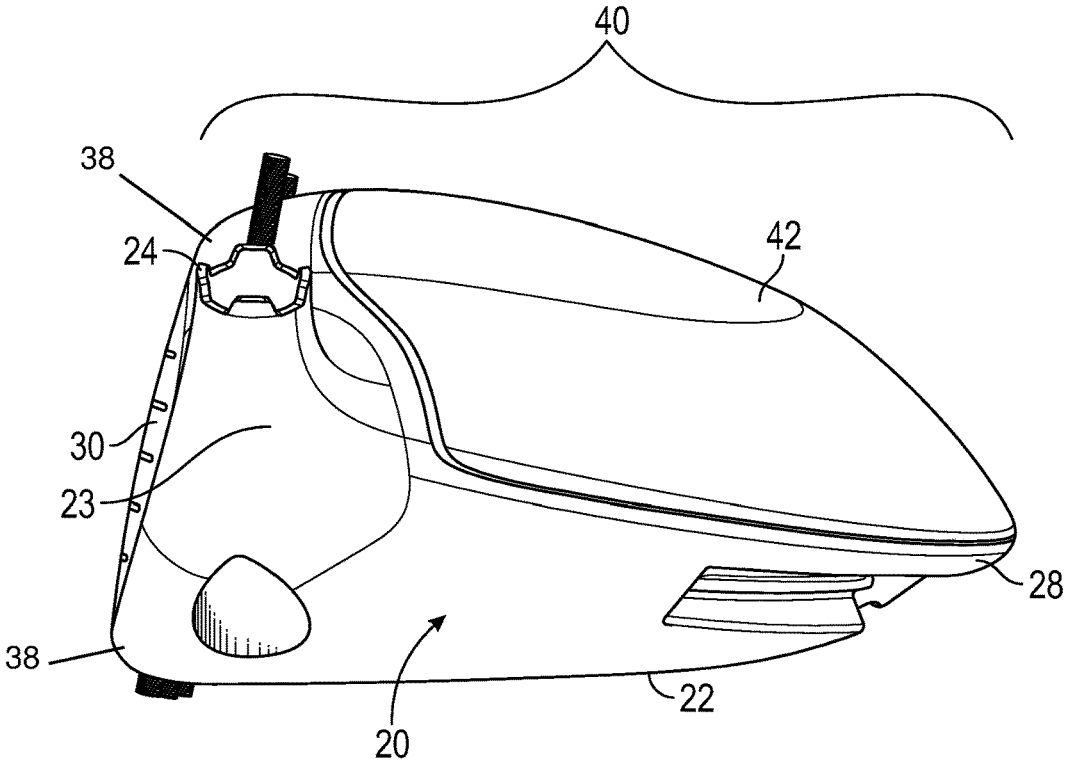
FIG. 2 is a side elevational view of the golf club head shown in FIG. 1.
Figure 3:
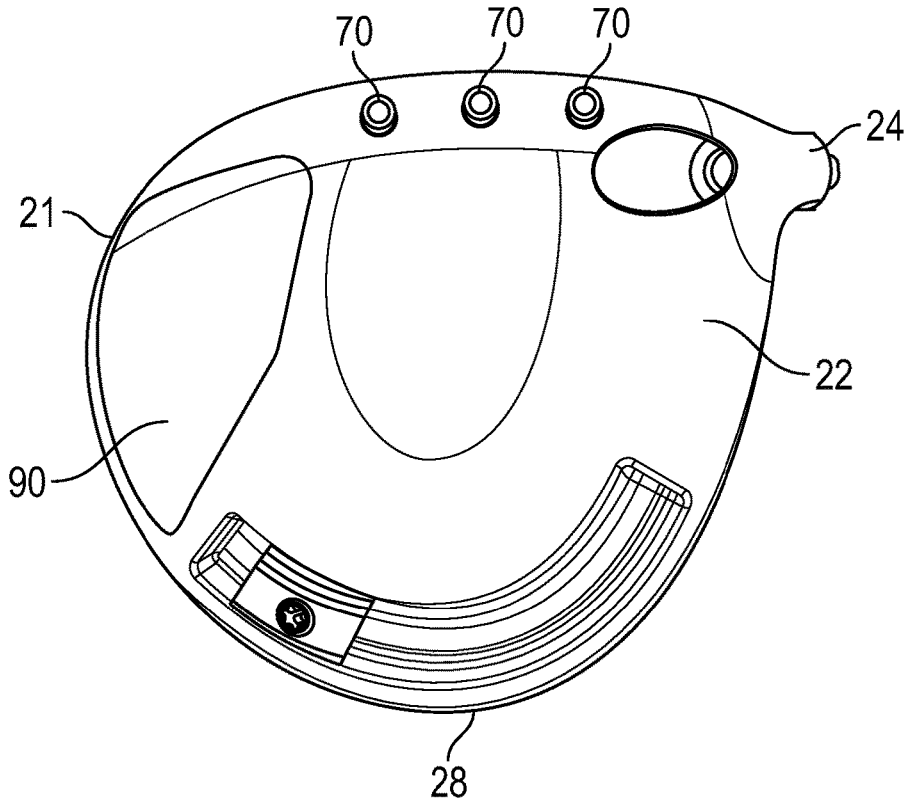
FIG. 3 is a sole elevational view of the golf club head shown in FIG. 1.
Figure 4:
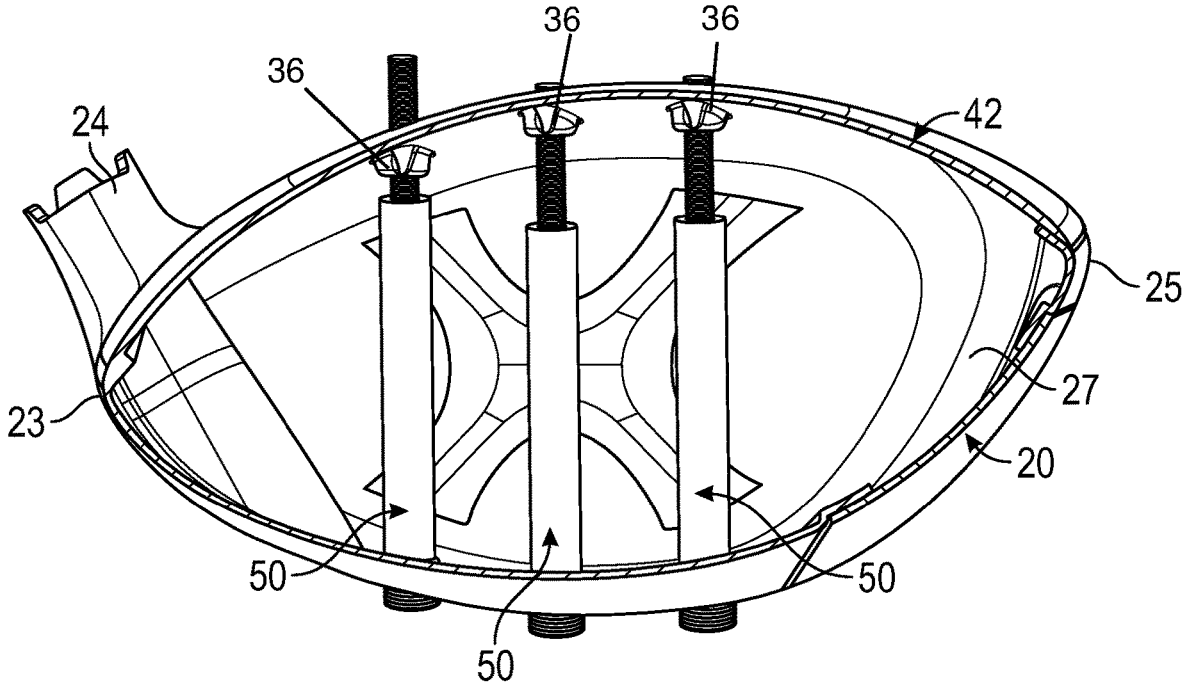
FIG. 4 is a cross-sectional view of the golf club head shown in FIG. 1 along lines 4-4.
Figure 5:
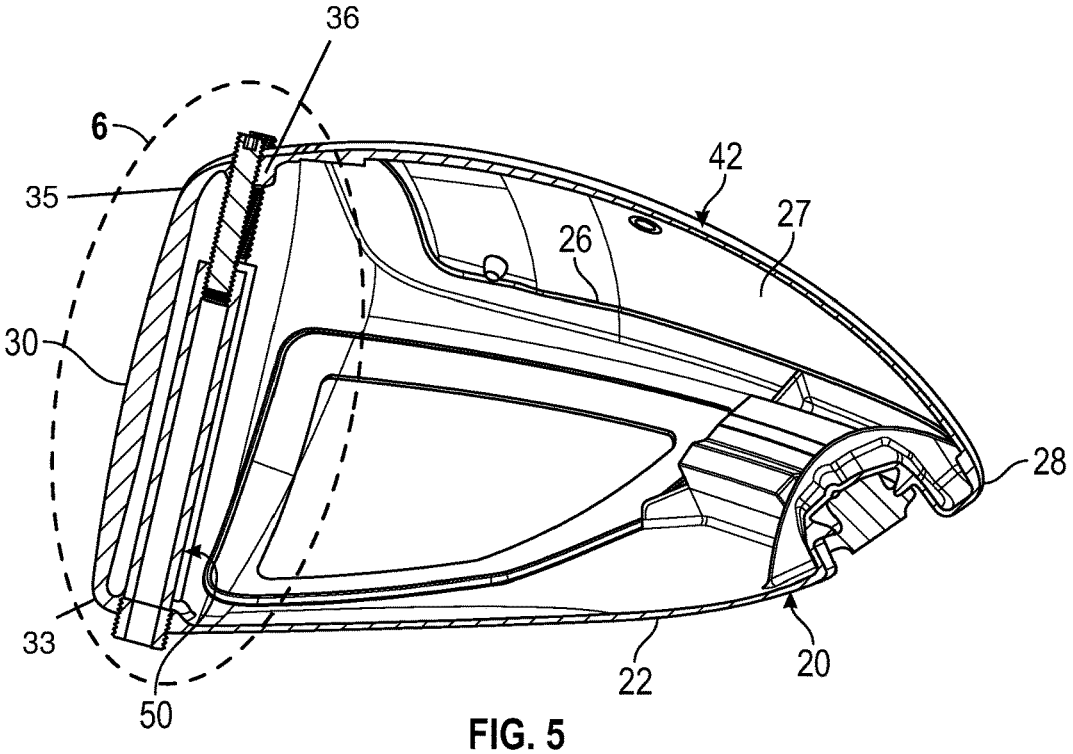
FIG. 5 is a cross-sectional view of the golf club head shown in FIG. 1 along lines 5-5.
Figure 6:
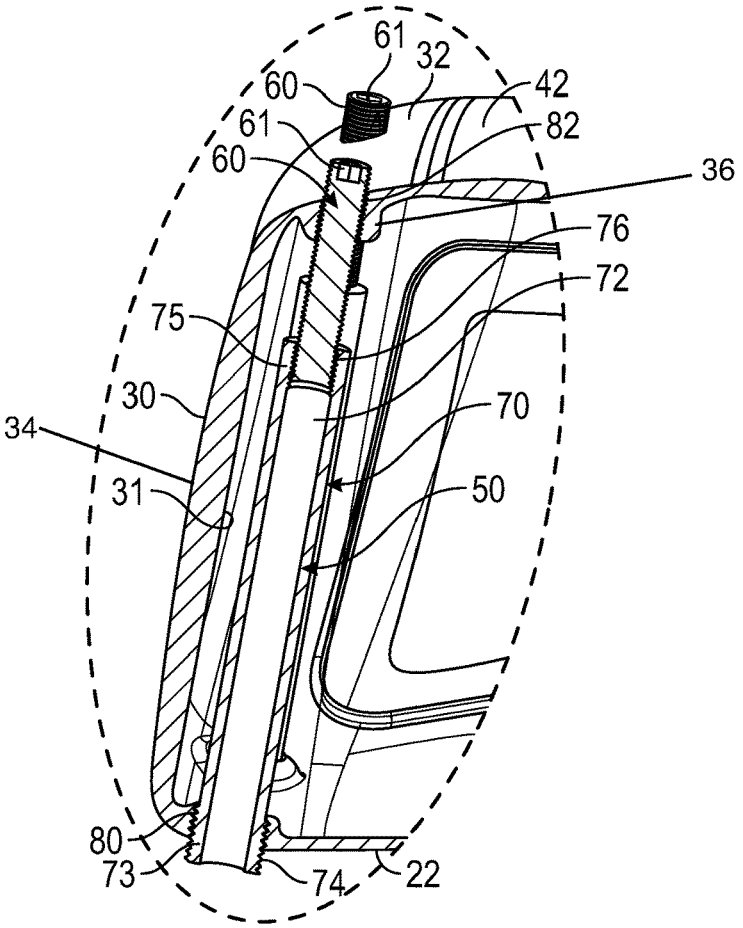
FIG. 6 is an enlarged view of the circled portion of the embodiment shown in FIG. 5.
Figure 7:
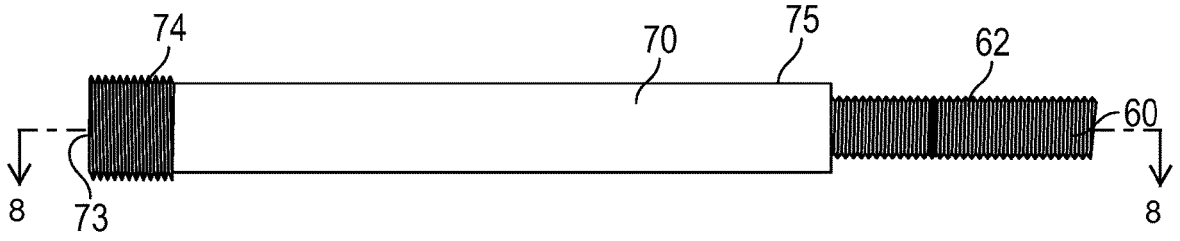
FIG. 7 is a side elevational view of one of the stiffening members shown in FIG. 1.
Figure 8:
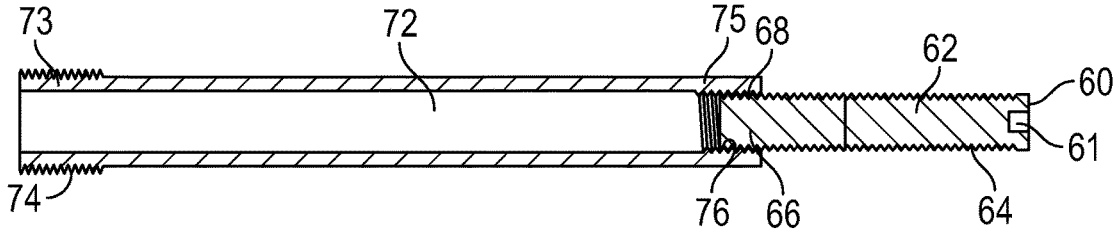
FIG. 8 is a cross-sectional view of the stiffening member shown in FIG. 7 along lines 8-8.

A preferred embodiment of the golf club head 10 of the present invention is shown in FIGS. 1-8. The golf club head 10 includes a body 20 having a sole section 22 that extends away from a lower edge 33 of a striking face section 30, a return section 32 extending away from an upper edge 35 of the striking face section 30, a hosel 24 for engaging a shaft, a heel end 23, a toe end 25, an upper opening 26, a hollow interior 27, and an aft end 28. The area where the return section 32 and sole section 22 connect with the striking face section 30 is known as the hinge region 38. A crown section 40 is comprised of the return section 32 and a crown insert 42 that is placed over the upper opening 26 to enclose the hollow interior 27. Within the hollow interior 27, three stiffening members 50 extend from the sole section 22 upward to the return section 32. In an alternative embodiment, the stiffening members 50 may extend to the crown insert 42 instead; what is important is that the stiffening members 50 connect the crown section 40 to the sole section 22, and that no part of the stiffening members 50 touches the striking face section 30 or is located more than 1 inch away from an interior surface 31 of the striking face section 30 in a front-to-back direction. In yet another alternative embodiment, only one or two stiffening members 50 may be engaged with the golf club head 10.

As shown in FIGS. 4-8, each of the stiffening members 50 in the preferred embodiment comprises an externally threaded rod 60 and a tube 70 with a through-bore 72 sized to receive the rod 60. The rod 60 has a first portion 62 with a first set of external threads 64 and a second portion 66 with a second set of external threads 68 oriented in a different direction than the first set of external threads 64; one set is right-handed, the other left-handed. A first end 73 of the tube 70 comprises external threads 74 and the second end 75 of the tube 70 comprises internal threads 76 sized to mate with one of the first and second sets of external threads 64, 68. Each of the return section 32 (or the crown section 40) and sole section 22 comprises threaded openings 80, 82, one of which is sized to mate with the external threads 74 of the tube 70 and the other one of which is sized to mate with one set of external threads 64, 68 of the rod 60. The openings 82 in the return section 32 preferably are supported by a plurality of bosses 36 extending into the hollow interior 27 of the body 20. During manufacturing, a tap can be used to independently thread the openings 80, 82 in the return section 32 and sole section 22, and the distance between each threaded end of each stiffening member 50 can be adjusted to allow alignment of the pitch of the rods 60 and tubes 70 with the pitch of the tapped return section 32 and sole section 22.

This construction allows each stiffening member 50 to be adjusted by a manufacturer or user so that the stiffening member 50 can be put in either compression or tension, placing different preloads on the spanned golf club head 10 and thus affecting the maximum stress experienced by certain portions of the structure, and particularly the striking face section 30, upon impact with a golf ball. Preloading is accomplished using a tool, such as a torque wrench or a screwdriver, which engages a tool opening 61 in the rod 60 to torque and push or pull the rod 60 further into or out of the sole section 22 or crown section 40. Preloading each stiffening member 50 as described, and particularly placing the stiffening members 50 in compression, reduces the peak stress placed on the striking face section 30 when the golf club head 10 impacts a golf ball, thereby reducing the risk that the striking face section 30, and particularly the hinge region 38, will crack under impact load. When all of the stiffening members 50 are preloaded to be in compression, the peak stress placed on the region of the body 20 located between the stiffening members 50 and the striking face section during impact with a golf ball is also lowered, as illustrated in Table I. In effect, preloading improves the resilience of the golf club head 10 during impact with a golf ball by distributing the stresses more evenly.

Table I shows peak stresses, in ksi, of the striking face section 30, inner mold line (IML) of the hinge region 38, and outer mold line (OML) of the hinge region 38 of the golf club head 10 of the present invention under the following conditions: (1) 20 lb node forces applied around the perimeter of each boss 36 parallel with the vector of each individual stiffening member 50, and in a way such that the net resultant force on the body 20=zero, while the total nodal forces=480 lb per stiffening member 50; (2) application of two sets of forces, one to shrink or compress the stiffening members 50, and one to extend or tension the stiffening members 50; (3) forces applied during the initial dynamic relaxation phase to simulate preload, such that the body 20 had reached equilibrium before transient impact portion of the analysis was conducted.

TABLE I

| Stiffening Member Configuration | Face Stress | IML Hinge Stress | OML Hinge Stress |
|---|---|---|---|
| Standard (control) | 168 | 162 | 222 |
| Compression | 168 | 132 | 189 |
| Tension | 176 | 198 | 258 |

Once the stiffening members 50 are placed in tension or compression so that the golf club head 10 is preloaded to a desired load value, any excess length of the stiffening members 50 extending through the openings 80, 82 is removed by any means known to a person of ordinary skill in the art, including but not limited to machining or cutting. The stiffening members 50 can then be permanently affixed to the golf club head via welding, brazing, or soldering, or with an adhesive such as Loctite®, though this step is not required and can be bypassed if a golfer wants to retain the ability to adjust the load placed on the stiffening members 50.

Each stiffening member 50 preferably is completely located within 1 inch, and more preferably within 0.500 inch, and most preferably within approximately 0.433 inch of the interior surface 31 of the striking face section 30, measured along a vertical plane extending through the face center 34 perpendicular to the striking face section 30 and in a front-to-back direction. Locating the stiffening members 50 within the region of the golf club head 10 defined above has the greatest stress-reducing effect on the golf club head 10, and particularly the striking face section 30.

The stiffening members of the present invention may be used as described herein in any type of golf club head with a hollow interior, including putters, irons, wedges, hybrids, fairway woods, and drivers. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams. The mass of the body 20, and thus the overall discretionary mass of the golf club head 10, can be adjusted by creating a cutout 21 in the sole section 22 and filling it with an insert 90 composed of a lightweight material such as carbon composite, plastic, or a low density metal alloy. Similarly, the crown insert 42 can be formed of a carbon composite material to free up additional discretionary mass.

The golf club head 10 preferably has a characteristic time (CT) of the striking face section 30 close to, but not exceeding, the 257 microsecond ("μS") limit set by the USGA, and the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which are hereby incorporated by reference. Alternatively, the striking face section 30 has a uniform thickness.

The materials used to make the various parts of the inventive golf club head 10 may vary, but in the preferred embodiment, each part of the stiffening members 50 preferably is composed of a solid, lightweight, strong metal material such as titanium alloy or steel. In an alternative embodiment, one or more of the parts of the stiffening members 50 can be composed of a lightweight metal or a composite material. The body 20 is preferably cast from molten metal in a method such as the lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body 20 using centrifugal casting, casting the body 20 using levitation casting, and like manufacturing methods.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face section, a sole section, and a return section, the sole section and return section defining a hollow interior; and at least one stiffening member comprising an externally-threaded rod and a tube having an internally threaded bore, wherein the rod comprises a first portion with a first set of external threads and a second portion with a second set of external threads, wherein the first set of external threads is oriented in a different direction than the second set of external threads, wherein the internally-threaded bore comprises a first set of internal threads oriented such that it mates with only one of the first and second sets of external threads, wherein at least a portion of the rod is disposed within the internally threaded bore, wherein the at least one stiffening member is at least partially disposed within the hollow interior and extends parallel with the striking face section between the return section and the sole section, wherein the at least one stiffening member is disposed no more than 1 inch from an interior surface of the striking face section, and wherein no part of the at least one stiffening member makes contact with the striking face section.

2. The golf club head of claim 1, wherein the tube comprises a first end, a second end, and a third set of external threads, wherein the internally threaded bore is disposed at the first end, and wherein the third set of external threads is disposed at the second end.

3. The golf club head of claim 2, wherein the rod comprises a tool engagement feature proximate the first set of external threads, wherein the first set of internal threads mates with the second set of external threads, and wherein using a tool to tighten the rod with respect to the tube causes the rod to move further into the internally threaded bore.

4. The golf club head of claim 1, wherein the return section comprises a first threaded opening, wherein the sole section comprises a second threaded openings, wherein the second threaded opening is aligned with the first threaded opening, wherein a portion of the rod is disposed within the first threaded opening, and wherein a portion of the tube is disposed within the second threaded opening.

5. The golf club head of claim 4, wherein the first threaded opening is supported by a boss extending into the hollow interior.

6. The golf club head of claim 1, wherein the return section comprises a first threaded opening, wherein the sole section comprises a second threaded opening, wherein the second threaded opening is aligned with the first threaded opening, wherein a portion of the rod is disposed within the second threaded opening, and wherein a portion of the tube is disposed within the first threaded opening.

7. The golf club head of claim 6, wherein the second threaded opening is supported by a boss extending into the hollow interior.

8. The golf club head of claim 1, wherein the body is composed of a metal alloy.

9. The golf club head of claim 8, wherein the metal alloy is selected from the group consisting of titanium alloy and steel.

10. The golf club head of claim 1, wherein the at least one stiffening member is composed of at least one metal material.

11. The golf club head of claim 1, wherein the at least one stiffening member is permanently affixed to the golf club head.

12. A golf club head comprising:

a face portion;

a crown portion extending from an upper edge of the face portion, the crown portion comprising a first threaded opening;

a sole portion extending from a lower edge of the face portion, the sole portion comprising a second threaded opening;

a hollow interior; and an adjustable-length stiffening member, wherein the second threaded opening is aligned with the first threaded opening, wherein the stiffening member is at least partially disposed within the hollow interior, wherein the stiffening member is engaged with each of the first and second threaded openings, wherein the stiffening member is disposed no more than 0.500 inch from an interior surface of the face portion, and wherein no part of the stiffening member makes contact with the striking face section.

13. The golf club head of claim 12, wherein the stiffening member extends parallel with the interior surface of the face portion.

14. The golf club head of claim 12, wherein the stiffening member comprises an externally-threaded rod and a tube having an internally threaded bore.

15. The golf club head of claim 14, wherein a portion of the rod is disposed within the first threaded opening, and wherein a portion of the tube is disposed within the second threaded opening.

16. The golf club head of claim 14, wherein a portion of the tube is disposed within the first threaded opening, and wherein a portion of the rod is disposed within the second threaded opening.

17. A golf club head comprising:

a metal body comprising a striking face section, a sole section extending from a lower edge of the striking face section, and a return section extending from an upper edge of the striking face section, the sole section and return section defining a hollow interior; and a metal stiffening member comprising an externally-threaded rod and a tube having an internally threaded bore, wherein at least a portion of the rod is disposed within the internally threaded bore, wherein the rod comprises a first portion with a first set of external threads and a second portion with a second set of external threads, wherein the first set of external threads is oriented in a different direction than the second set of external threads, wherein the internally-threaded bore comprises a first set of internal threads, wherein the first set of internal threads is oriented such that it mates with only one of the first and second sets of external threads, wherein the length of the stiffening member can be adjusted by altering the position of the externally threaded rod within the internally threaded bore, wherein the stiffening member is at least partially disposed within the hollow interior and extends parallel with an interior surface of the striking face section between the return section and the sole section, wherein the stiffening member is engaged with each of the return section and the sole section, and wherein the at least one stiffening member is disposed no more than 1 inch from the interior surface of the striking face section.

18. The golf club head of claim 17, wherein the at least one stiffening member is disposed no more than 0.433 inch from the interior surface of the striking face section.

19. The golf club head of claim 17, wherein the golf club head has a volume of 420 cubic centimeters to 470 cubic centimeters and a mass of no more than 215 grams.

20. The golf club head of claim 17, wherein the striking face section has a variable thickness.

* * * * *